US007416617B2

(12) United States Patent
Murao et al.

(10) Patent No.: US 7,416,617 B2
(45) Date of Patent: Aug. 26, 2008

(54) HIGH STRENGTH SEAMLESS STEEL PIPE EXCELLENT IN HYDROGEN-INDUCED CRACKING RESISTANCE

(75) Inventors: Nobutoshi Murao, Wakayama (JP); Nobuyuki Hisamune, Wakayama (JP); Hajime Osako, Wakayama (JP); Kunio Kondo, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 358 days.

(21) Appl. No.: 11/088,740

(22) Filed: Mar. 25, 2005

(65) Prior Publication Data

US 2005/0167013 A1 Aug. 4, 2005

Related U.S. Application Data

(63) Continuation of application No. PCT/JP03/12373, filed on Sep. 26, 2003.

(30) Foreign Application Priority Data

Oct. 1, 2002 (JP) ..... 2002-288661
Feb. 27, 2003 (JP) ..... 2003-051427

(51) Int. Cl.
*C22C 38/22* (2006.01)
*C22C 38/28* (2006.01)
*C22C 38/50* (2006.01)

(52) U.S. Cl. ..... 148/334; 148/330; 148/335

(58) Field of Classification Search ..... 148/909, 148/333–335, 320, 590, 593, 663, 654; 420/111, 420/110

See application file for complete search history.

(56) References Cited

U.S. PATENT DOCUMENTS 6,183,573 B1 2/2001 Fujiwara et al.

FOREIGN PATENT DOCUMENTS

| | | | |
|---|---|---|---|
| AR | 001298 A1 | | 10/1997 |
| AR | 001655 A1 | | 11/1997 |
| AR | 004345 A1 | | 11/1998 |
| AR | 005719 A1 | | 7/1999 |
| AR | 011312 A1 | | 8/2000 |
| AR | 013245 A1 | | 12/2000 |
| AR | 020928 A1 | | 6/2002 |
| EP | 0-733-715 A2 | | 9/1996 |
| GB | 1-491-729 | | 12/1974 |
| JP | 50-97515 | | 8/1975 |
| JP | 53-106318 | | 9/1978 |
| JP | 57-5819 | | 1/1982 |
| JP | 407216500 | * | 8/1995 |

(Continued)

*Primary Examiner*—Deborah Yee
(74) *Attorney, Agent, or Firm*—Clark & Brody

(57) ABSTRACT

A high strength seamless steel pipe having mgh yield stress and excellent hydrogen-induced cracking resistance, comprises by mass %, C: 0.03-0.11%, Si: 0.05-0.5%, Mn: 0.8-1.6%, p: 0.025% or less, S: 0.003% or less, Ti: 0.002-0.017%, Al: 0.001-0.10%, Cr: 0.05-0.5%, Mo: 0.02-0.3%, V: 0.02-0.20%, Ca 0.0005-0.005%, N: 0.008% or less and O (Oxygen): 0.004% or less, the balance Fe and impurities. The steel microstructure is bainite and/or martensite and ferrite is precipitated at grain boundaries. The seamless steel pipe can contain at least one of Cu: 0.05-0.5% and Ni: 0.05-0.5%. To produce the pipe, it is desirable to limit a starting temperature of quenching after rolling, a cooling rate and a tempering temperature.

2 Claims, 1 Drawing Sheet

20 μm

FOREIGN PATENT DOCUMENTS

| | | |
|---|---|---|
| JP | 8-283906 | 10/1996 |
| JP | 8325641 | 12/1996 |
| JP | 10-176239 | 6/1998 |
| JP | 11-140580 | 5/1999 |
| JP | 2000-104117 | 4/2000 |

* cited by examiner

HIGH STRENGTH SEAMLESS STEEL PIPE EXCELLENT IN HYDROGEN-INDUCED CRACKING RESISTANCE

This application is a continuation of International Patent Application No. PCT/JP2003/012373, filed Sep. 26, 2003.

BACKGROUND OF THE INVENTION

1. Field of the Invention

The present invention relates to a seamless steel pipe excellent in hydrogen-induced cracking resistance (hereinafter referred to as "HIC resistance"), which is used as a line pipe having 5L-X70 grade or higher of American Petroleum Institute (API) Standard in strength level.

2. Related Art

In recent years, well conditions of an oil well for crude oil and a gas well for natural gas (hereinafter referred to as only "oil well and the like" generally) become severe and the transportation of the crude oil and natural gas has been performed under a severe environment. As the depth of water is increased, the well condition of the oil well and the like tends to contain $CO_2$, $H_2S$, Cl—, and the like in the ambient, and $H_2S$ is often contained in the crude oil and natural gas.

When the oil well and the like are in the seabed, as the depth of water is increased, an off shore pipe line is demanded for high strength and thick wall thickness to stand the water pressure on the seabed. As the off shore pipeline in such deep sea seamless steel pipes are usually used.

In a pipeline used for the transportation of crude oil or natural gas containing much $H_2S$, not only corrosion of a surface of a steel material due to $H_2S$, but also a fracture phenomenon of the steel material such as hydrogen-induced cracking or hydrogen-induced blistering or the like (hereinafter referred to as "HIC" generally) due to absorption of hydrogen generated by the corrosion into steel, are generated. This HIC is different from the sulfide stress corrosion cracking, which is conventionally recognized in a high strength steel, and does not depend on external stress so that the occurrence of HIC is recognized without external stress.

When such an HIC is occurred in a transporting pipeline, it may lead to a breakage accident of the pipeline. As a result a large scale environmental breakage due to leakage of crude oil or natural gas tends to occur. Accordingly, in the transporting pipelines for crude oil and natural gas, it is an important matter to prevent the occurrence of HIC.

The above-mentioned HIC is a steel material fracture phenomenon that inclusions such as MnS, $Al_2O_3$, CaO, CaS and the like existing in steel are changed, during the rolling of a steel material, to elongated ones in the rolling direction or crushed cluster-like ones, hydrogen absorbed into the interfaces between these inclusions and matrix steel is accumulated and gasified, cracks are generated by the gas pressure of the accumulated hydrogen, and these cracks propagate in steel.

To prevent the HIC, which exhibits such behaviors in steel, various steel materials for a line pipe has been proposed. For example, Japanese Patent Application Laid-open No. S50-97515 proposes steel for a line pipe in which Cu: 0.2-0.8% is added to steel having strength of X42-X80 grade in the API standard to form an anticorrosive film thereby preventing hydrogen from absorbing into the matrix steel.

Further, Japanese Patent Application Laid-open No. S53-106318 proposes a steel material for a line pipe in which Ca: excess 0.005%-0.020 or less %, which is comparatively a large amount, is added to steel and inclusion (MnS) in steel is spheroidized by a shape control by Ca treatment thereby reducing cracking sensitivity. Even at present HIC resistant steel has been produced based on these proposed technologies.

Further, since the principal use of the HIC resistant steel is a transporting pipeline for crude oil and natural gas, weldability is important. Thus a low-carbon steel is applied to the HIC resistant steel, but high strength steel is difficult to obtain due to the low C content of the steel. On the other hand, as mentioned above, consumers require for high strength materials. Thus, to satisfy the requirement, the following steps are often performed: after finish rolling a steel pipe by hot rolling, the steel pipe is heated and quenched, and subsequently tempered.

Such quenching and tempering treatment of a rolled steel pipe is effective for avoiding a ferrite and pearlite band-shaped microstructure in which HIC is liable to occur.

As mentioned above, in the steel material for a line pipe the weldability is important and high strength is required. Thus, after hot rolling, a rolled steel pipe is often subjected to be quenched and tempered. Further, in producing a seamless steel pipe, from the view points of a suppression of an increase in equipment costs and the production efficiency, it has been considered to adopt a treatment applying quenching and tempering after soaking, without cooling a finish-rolled steel pipe to $Ar_3$ point, by directly connecting a pipe rolling line to a heat treatment line (hereinafter sometimes referred to as only "inline quenching/tempering (QT)").

Accordingly, to improve the HIC resistance of a high strength steel material for a line pipe, a seamless steel pipe of a high strength material was produced by quenching and tempering after soaking without cooling the rolled steel pipe to $Ar_3$ point after hot rolling by the use of a previously proposed steel in which inclusions (MnS) are shape-controlled by Ca treatment. However, the occurrence of HIC exhibiting a form of an intergranular fracture was observed. Thus, even if the HIC resistant steel proposed in the above-described Japanese Patent Application Laid-open No. S53-106318 and the like was applied to a high strength steel, the HIC resistance is not necessarily improved.

SUMMARY OF THE INVENTION

The present invention was made in consideration to the production of a seamless steel pipe having high strength and HIC resistance, and an object of the present invention is to provide a high strength seamless steel pipe, which can exhibit excellent HIC resistance and its production method.

The present inventors have collated the knowledge about behaviors of HIC, which occurs in a line pipe, to solve the above-mentioned problem.

As explained above, HIC is a breakage of steel by hydrogen-induced cracking or hydrogen-induced blistering, which is generated by the facts that hydrogen generated by corrosion absorbs into the steel and accumulates at the interface between the inclusions in the steel and the matrix steel and gasifies, and that the gas pressure is increased more than the yield strength of the steel to generate cracks, which propagate in the steel.

Therefore, in a conventional technology, an inclusion shape control and the like, for example, were performed so that the absorbed hydrogen hardly gasificates. However, for the high strength steel having 5L-X70 grade or higher of API, all of starting point of HIC is not at inclusions, and an HIC fracture exhibits a fracture like sulfide stress-corrosion cracking and can exhibit a form of intergranular fracture.

Hence, the relationships between HIC resistance of steel and a quenched microstructure thereof were further reviewed.

As a result it has been newly found that even in a bainite and/or martensite quenched microstructure, the brittleness of a grain boundary is prevented by precipitating ferrite on the grain boundaries and even if a minute crack is occurred in steel, the propagation of the crack can be suppressed whereby a seamless steel pipe having excellent HIC resistance can be obtained.

The present invention has been completed based on the above-mentioned knowledge and the gist of the present invention is the following high strength seamless steel pipes (1) and (2) and the following production method of the high strength seamless steel pipe (3).

(1) A high strength seamless steel pipe excellent in HIC resistance, characterized by consisting of, by mass %, C, 0.03-0.11%, Si: 0.05-0.5%, Mn: 0.8-1.6%, P: 0.025% or less, S: 0.003% or less, Ti: 0.002-0.017%, Al: 0.001-0.1%, Cr: 0.05-0.5%, Mo: 0.02-0.3%, V: 0.02-0.20%, Ca: 0.0005-0.005%, N, 0.008% or less and O (Oxygen): 0.004% or less, and the balance Fe and impurities, and also characterized in that the microstructure of steel is bainite and/or martensite, ferrite is precipitated on grain boundaries and yield stress is 483 MPa or more.

(2) A high strength seamless steel pipe, in addition to the above-mentioned seamless steel pipe (1), further preferably containing, by mass %, at least one of Cu: 0.05-0.5% and Ni: 0.05-0.5%.

(3) A production method of a high strength seamless steel pipe excellent in HIC resistance, characterized in that after rolling a billet having a composition described in the above-mentioned (1) or (2) to a seamless steel pipe by hot rolling, said seamless steel pipe is immediately soaked and then cooled at a starting temperature of quenching of ($Ar_3$ point+50° C.) to 1100° C. and at a cooling rate of 5° C./sec or more, and then said seamless steel pipe is tempered at 550° C. to $Ac_1$ points, whereby a seamless steel pipe in which the microstructure of steel is bainite and/or martensite, ferrite is precipitated at grain boundaries and yield stress is 483 MPa or more is produced.

DETAILED DESCRIPTION OF THE PREFERRED EMBODIMENT

Figure 1:
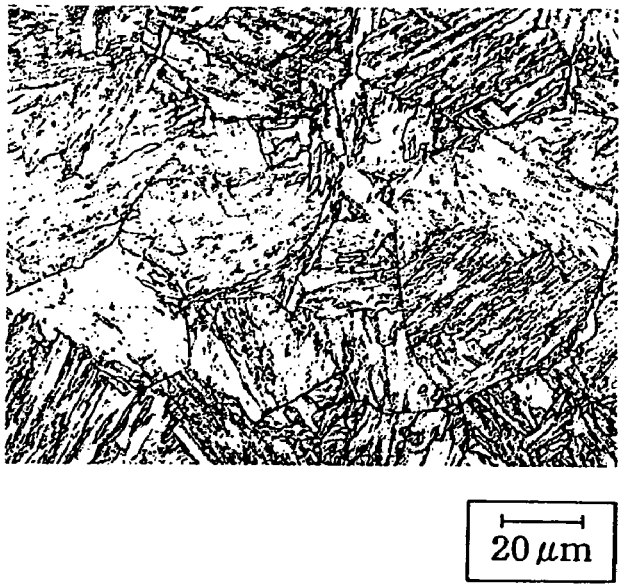
FIG. 1 is a view showing a microstructure photograph of a seamless steel pipe inferior in HIC resistance.

Reasons for defining a chemical composition, a steel pipe microstructure and a production method as those described above in the present invention, will be explained. First, the reason for defining chemical composition of a seamless steel pipe according to the present invention will be described. In the following descriptions, the chemical composition is shown by mass %.

1. Chemical Composition of Steel

C, 0.03-0.11%

C (Carbon) is an element necessary to enhance hardenability and to increase the strength of the steel. When the content of C is less than 0.03%, the hardenability are lowered, and high strength is difficult to ensure. On the other hand, when the content of C exceeds 0.11%, in a case where QT is applied, the steel tends to have a fully quenched microstructure such as bainite and/or martensite or the like, whereby the HIC resistance of the steel is not only lowered but also weldability is lowered.

Si: 0.05-0.5%

Si (Silicon) is added to steel for the purpose of deoxidation of steel, and contributes to an increase in strength and enhancing a softening resistance during tempering the steel. To obtain these effects the addition of 0.05% or more Si is needed. However, since the excess addition of Si decreases toughness of the steel, the Si content was set to 0.5% or less.

Mn: 0.8-1.6%

Mn (Manganese) is an effective element for increasing hardenability of the steel to increase strength thereof and for enhancing hot workability of the steel. Particularly, to enhance the hot workability of steel 0.8% or more Mn is needed. However, since the excess addition of Mn decreases toughness and weldability of steel, the Mn content was set to 1.6% or less.

P: 0.025% or Less

P (Phosphorus) exists in the steel as impurities. Since the segregation of P in grain boundaries deteriorates toughness of steel, the P content was set to 0.025% or less. The P content is preferably 0.015% or less, and more preferably 0.009% or less.

S: 0.003% or Less

S (Sulfur) exists in the steel as impurities. Since S generates sulfides such as MnS and the like and deteriorates HIC resistance, the S content was set to 0.003% or less. The S content is preferably 0.002% or less, and more preferably 0.001% or less.

Ti: 0.002-0.017%

Ti (Titanium) is an element effective to prevent cracking of the billet. To exhibit the effect the Ti content of 0.002% or more is needed. On the other hand, since excessive addition of Ti deteriorates toughness of the steel, the Ti content was set to 0.017% or less, and preferably 0.010% or less.

Al: 0.001-0.10%

Al (Aluminum) is an indispensable element for deoxidation of the steel. When the Al content is too small, deoxidation becomes insufficient and surface defects are generated on the billet to deteriorate the property of steel. Thus, the Al content was set to 0.001% or more. On the other hand, since excessive addition of Al generates cracks in the billet, which leads to deterioration of the steel property. Thus the Al content was set to 0.10% or less, and preferably 0.040% or less.

Cr: 0.05-0.5%

Cr (Chromium) is an element for enhancing the strength of the steel. The significant effect can be obtained by addition of 0.05% or more Cr. However, since even excessive addition of Cr saturates the effect, the Cr content was set to 0.5% or less.

Mo: 0.02-0.3%

Mo Molybdenum) is an element for enhancing the strength of the steel. The significant effect can be obtained by addition of 0.02% or more Mo. However, since even excessive addition of Mo saturates the effect, the Mo content was set to 0.3% or less.

V: 0.02-0.20%

V (Vanadium) is an element for enhancing the strength of the steel. The significant effect can be obtained by addition of 0.02% or more V. However, since even excessive addition of V saturates the effect, the V content was set to 0.20% or less and preferably 0.09% or less.

Ca: 0.0005-0.005%

Ca (Calcium) is used for the shape controlling of inclusion. To enhance the HIC resistance by sphering the MnS inclusions, the Ca content of 0.0005% or more is needed. On the other hand, when the Ca content exceeds 0.005%, the effect is saturated and further effects cannot be exhibited. Additionally, Ca inclusions tend to be clusters so that the HIC resistance is lowered. Accordingly, the upper limit of Ca content was set to 0.005%.

N, 0.008% or Less

N (Nitrogen) exists in the steel as impurities. When the N content is increased, cracks are generated in the billet so that the steel property deteriorates. Thus the N content was set to 0.008% or less. Preferably, the N content is 0.006% or less.

O (Oxygen): 0.004% or Less

The O content means a total content of soluble oxygen in the steel and oxygen in oxide inclusions. This O content is substantially the same as the O content in oxide inclusions in the sufficiently deoxidized steel. Therefore, as the O content is increased, there exist increased oxide inclusions in the steel thereby decreasing HIC resistance. Accordingly, smaller O content is better and the O content was set to 0.004% or less.

Cu (Copper): 0.05-0.5%, Ni (Nickel): 0.05-0.5%

These elements are for enhancing the strength of the steel. Thus, when the strength of the steel should be ensured one of the elements or both of the elements can be contained. The effect becomes significant in each Cu, Ni content of 0.05% or more. However, since excessive addition of any element saturates the effect, the content of each element was set to 0.5% or less.

Nb: The Nb (Niobium) content does not influence on the HIC resistance and strength of the steel. Thus the Nb element can be cared as an impurity element and its content is not be defined in the present invention. However, when the Nb content exceeds 0.1%, undesirable effects such as deterioration of the toughness of the steel become significant. Thus the Nb content range is preferably 0.1% or less.

2. Steel Pipe Microstructure and its Production Method

In the seamless steel pipe of the present invention, a steel pipe microstructure must be a quenched microstructure such as bainite and/or martensite to ensure the strength of 5L-X70 grade or more by use of a comparatively low C steel as shown by the above-mentioned chemical compositions. To obtain the microstructure the inline QT is preferably applied.

However, since only a bainite and/or martensite fully quenched microstructure tends to generate HIC, which exhibits a form of an intergranular fracture such as sulfide stress-corrosion cracking, it is important to precipitate ferrite on the grain boundary.

In the present invention the precipitation of ferrite on the bainite and/or martensite grain boundary has an effect to prevent the generation of HIC, which exhibits a form of a intergranular fracture such as sulfide stress-corrosion cracking, while ensuring the strength of 5L-X70 grade or more.

FIG. 1 is a view showing a microstructure photograph of a seamless steel pipe inferior in HIC resistance. The microstructure in FIG. 1 is a structure etched by a nital and exhibits a bainite and/or martensite fully quenched microstructure in which prior austenite grain boundaries can be clearly recognized. In a case of such a microstructure an HIC, which exhibits a form of intergranular fracture such as sulfide stress-corrosion cracking, tends to generate.

Figure 2:
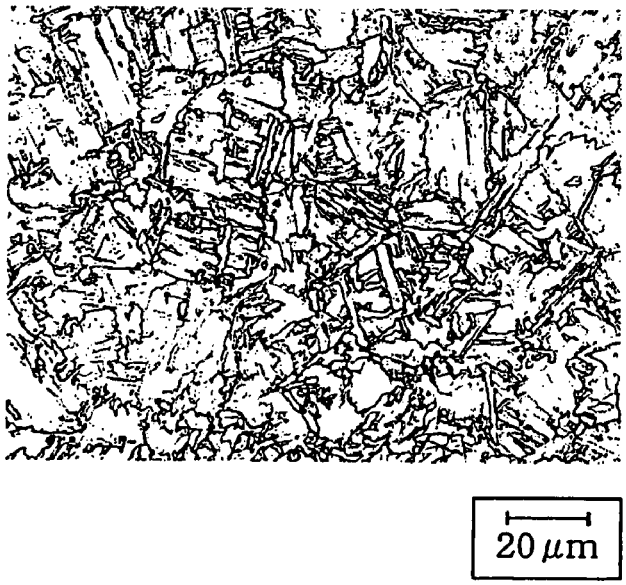
FIG. 2 is a view showing a microstructure photograph of a seamless steel pipe excellent in HIC resistance.

On the contrary, FIG. 2 is a view showing a microstructure photograph of a seamless steel pipe excellent in HIC resistance relating to the present invention. FIG. 2 shows a microstructure etched by a nital as in FIG. 1. Because a ferrite phase is generated in the grain boundary, the prior austenitic grain boundaries are not clear in the microstructure. In a case of such a microstructure, the HIC, which shows a form of intergranular fracture, is not occurred.

In the present invention, by defining the above-described microstructure while using a billet containing the chemical composition defined by the present invention as a material, a seamless steel pipe excellent in an aimed performance i.e. HIC resistance can be obtained. A preferable production method for obtaining a seamless steel pipe, which satisfies the microstructure and the high strength simultaneously, is shown as follows.

That is, after heating a billet and finish rolling it to a shape of a steel pipe by hot working, the obtained steel pipe is soaked immediately to a temperature of ($Ar_3$ point+50° C.) or more by use of soaking furnace without cooling it to the $Ar_3$ point and is quenched.

When the starting temperature of quenching is less than ($Ar_3$ point+50° C.), variation is generated in strength. On the other hand, when the starting temperature of quenching is increased, toughness of the steel pipe is significantly lowered. Thus, the starting temperature of quenching must be 1100° C. or less. Therefore, the starting temperature of quenching is set to ($Ar_3$ point+50° C.) to 1100° C.

The quenching of the finish rolled steel pipe is performed by cooling it to room temperature, for example, while keeping the cooling rate of 5° C./sec. When the cooling rate during this quenching is less than 5° C./sec, a microstructure including martensite and bainite required for obtaining necessary strength cannot be ensured. Thus, the cooling rate of 5° C./sec or more should be kept.

To prevent the reduction of strength in a heat affected zone of welding a tempering temperature of 550° C. or more is needed. However, when the tempering temperature exceeds $Ac_1$ point, the strength of the steel pipe is decreased. Accordingly, the tempering must be performed under a temperature condition of 550° C. to $Ac_1$ point.

The present invention does not limit production steps until finish rolling a steel pipe from a billet, which is a starting material. Alternatively, by adopting, for example, a Mannesmann-mandrel mill process a billet cast by a continuous casting machine or a billet obtained by rolling in a blooming mill after casting is heated and a hollow shell is obtained by a piercer such as a inclined rolling mill. After that a mandrel bar is inserted into the pipe to roll it, a finish rolling is performed by use of a sizer or reducer.

It is noted that even in a production method other than the production methods described in said (3) of the present invention, a seamless steel pipe having the chemical compositions and microstructure defined in said (1) or (2) of the present invention can obtain the HIC resistance of the present invention.

EXAMPLE 1

Some kinds of steels, having chemical compositions shown in Table 1, were melted by a converter. Billets produced by continuous casting were heated to 1100° C. or more and hollow shells were obtained by use of a tilting roller piercer. These hollow shells were finish rolled to steel pipes by a mandrel mill and a sizer. After that without cooling the steel pipes to $Ar_3$ point or less, they were soaked at 950° C. and subjected to quenching and tempering treatment to produce seamless steel pipes. The steel pipe sizes and heat treatment conditions are shown in Table 2. In this case the cooling rate was set to 30° C./sec.

Tensile test specimens of JIS 12 were taken from the obtained steel pipes as tensile tests and tensile strength (TS) and yield strength (YS) were measured. It is noted that the tensile tests were performed in accordance with JIS Z 2241.

Further, specimens having thickness of 12 to 20 mm, width of 20 mm and length of 100 mm were taken for HIC resistance tests. The specimens were immersed into a $H_2S$-saturated 0.5% $CH_3COOH$-5% NaCl water solution (temperature of 25° C., pH=2.7-4.0, so called NACE environment) for 96 hours, and crack area ratios (CAR (%)) were measured. These results are shown in Table 2.

Further, after the HIC resistance tests, cross-sections of the HIC test specimens were cut off and their microstructure were observed by an optical microscope. The obtained observation results are shown in Table 2.

As can be seen from Table 2 the all steels of Nos. 1 to 14 according to example of the present invention satisfy strength of 5L-X70 grade, and have an excellent condition of CAR=0%.

On the other hand, the steel of No. 15 in comparative examples has C and O content, which are outside their definition of the present invention, and ferrite is not precipitated at the interface whereby a deteriorated result of CAR=12.6% was obtained. Also the C content of the steel of No. 16 is outside the specified values of the present invention, and ferrite does not exist at the grain boundary whereby a deteriorated result of CAR=7.9% was obtained.

Further, the steel of No. 17 in comparative examples has 0 content outside the specified values of the present invention and a deteriorated result of CAR=6.2% was obtained by inclusion. The steel of No. 18 has Ca content outside the definition of the present invention and a deteriorated result of CAR=3.6% was obtained due to inclusion.

TABLE 1

| Steel | Chemical composition (mass %) Balance: Fe and impurities | | | | | | | | | | | | | | |
|---|---|---|---|---|---|---|---|---|---|---|---|---|---|---|---|
| No. | C | Si | Mn | P | S | Ti | Al | Ca | N | O | Cu | Cr | Ni | Mo | V |
| 1 | 0.06 | 0.09 | 1.29 | 0.007 | 0.002 | 0.008 | 0.033 | 0.0020 | 0.0055 | 0.0017 | — | 0.28 | — | 0.21 | 0.05 |
| 2 | 0.06 | 0.33 | 1.43 | 0.011 | 0.002 | 0.008 | 0.029 | 0.0036 | 0.0047 | 0.0025 | — | 0.27 | 0.19 | 0.22 | 0.06 |
| 3 | 0.06 | 0.29 | 1.36 | 0.008 | 0.001 | 0.007 | 0.034 | 0.0032 | 0.0045 | 0.0020 | — | 0.26 | 0.07 | 0.21 | 0.05 |
| 4 | 0.08 | 0.27 | 1.29 | 0.021 | 0.002 | 0.003 | 0.022 | 0.0025 | 0.0048 | 0.0019 | — | 0.49 | — | 0.02 | 0.02 |
| 5 | 0.08 | 0.28 | 1.02 | 0.024 | 0.001 | 0.008 | 0.027 | 0.0010 | 0.0039 | 0.0016 | 0.28 | 0.26 | 0.26 | 0.16 | 0.05 |
| 6 | 0.11 | 0.22 | 1.24 | 0.014 | 0.002 | 0.009 | 0.039 | 0.0018 | 0.0052 | 0.0017 | — | 0.21 | — | 0.12 | 0.04 |
| 7 | 0.07 | 0.32 | 1.41 | 0.008 | 0.002 | 0.008 | 0.037 | 0.0005 | 0.0043 | 0.0012 | — | 0.05 | — | 0.02 | 0.10 |
| 8 | 0.09 | 0.29 | 1.36 | 0.019 | 0.001 | 0.017 | 0.032 | 0.0023 | 0.0077 | 0.0020 | — | 0.26 | 0.07 | 0.21 | 0.03 |
| 9 | 0.04 | 0.41 | 0.82 | 0.006 | 0.003 | 0.012 | 0.026 | 0.0027 | 0.0064 | 0.0029 | 0.44 | 0.37 | 0.48 | 0.24 | 0.03 |
| 10 | 0.04 | 0.34 | 1.16 | 0.016 | 0.002 | 0.008 | 0.044 | 0.0048 | 0.0056 | 0.0033 | — | 0.12 | — | 0.04 | 0.08 |
| 11 | 0.03 | 0.24 | 1.48 | 0.011 | 0.002 | 0.015 | 0.041 | 0.0026 | 0.0074 | 0.0022 | 0.29 | 0.23 | 0.33 | 0.09 | 0.04 |
| 12 | 0.08 | 0.26 | 1.59 | 0.013 | 0.001 | 0.009 | 0.032 | 0.0023 | 0.0047 | 0.0016 | — | 0.22 | — | 0.06 | 0.03 |
| 13 | 0.04 | 0.29 | 1.51 | 0.007 | 0.001 | 0.006 | 0.026 | 0.0033 | 0.0042 | 0.0040 | 0.16 | 0.24 | 0.12 | 0.08 | 0.05 |
| 14 | 0.05 | 0.38 | 1.46 | 0.012 | 0.001 | 0.007 | 0.046 | 0.0029 | 0.0044 | 0.0018 | — | 0.05 | — | 0.30 | 0.06 |
| 15 | *0.13 | 0.26 | 1.31 | 0.009 | 0.001 | 0.008 | 0.037 | 0.0030 | 0.0070 | *0.0053 | — | 0.19 | 0.03 | 0.09 | 0.03 |
| 16 | *0.12 | 0.22 | 1.36 | 0.012 | 0.003 | 0.007 | 0.028 | 0.0026 | 0.0038 | 0.0027 | — | 0.17 | 0.03 | 0.04 | 0.04 |
| 17 | 0.07 | 0.30 | 1.25 | 0.008 | 0.001 | 0.007 | 0.035 | 0.0034 | 0.0036 | *0.0049 | 0.04 | 0.17 | 0.03 | 0.13 | 0.04 |
| 18 | 0.06 | 0.29 | 1.36 | 0.008 | 0.001 | 0.012 | 0.042 | *0.0003 | 0.0056 | 0.0026 | — | 0.14 | — | 0.04 | 0.05 |
| 19 | 0.05 | 0.28 | *1.78 | 0.011 | 0.002 | 0.008 | 0.034 | 0.0032 | 0.0046 | 0.0020 | — | 0.11 | — | 0.02 | 0.05 |
| 20 | *0.02 | 0.34 | 1.33 | 0.016 | 0.002 | 0.008 | 0.046 | 0.0028 | 0.0054 | 0.0029 | 0.28 | 0.23 | 0.43 | 0.15 | 0.03 |
| 21 | 0.05 | 0.23 | 1.36 | 0.013 | 0.001 | 0.009 | 0.039 | *0.0052 | 0.0063 | 0.0034 | — | 0.16 | — | 0.05 | 0.06 |

Note:
"*" in Table shows out of range specified in the present invention.

TABLE 2

| | | Steel pipe size | | Heat treatment condition | | Test result | | | | |
|---|---|---|---|---|---|---|---|---|---|---|
| | Steel No. | Outer diameter (mm) | Wall thickness (mm) | Cooling starting temperature (° C.) | Tempering temperature (° C.) | TS (MPa) | YS (MPa) | Ferrite precipitation at grain boundary | Microstructure | CAR (%) |
| Present invention example | 1 | 323.9 | 40.0 | 950 | 650 | 583 | 509 | Yes | F + B + M | 0 |
| | 2 | 219.1 | 29.2 | 950 | 650 | 641 | 569 | Yes | F + B + M | 0 |
| | 3 | 219.1 | 37.8 | 950 | 650 | 602 | 526 | Yes | F + B + M | 0 |
| | 4 | 219.1 | 19.1 | 950 | 650 | 604 | 520 | Yes | F + B + M | 0 |
| | 5 | 323.9 | 34.1 | 950 | 650 | 605 | 522 | Yes | F + B + M | 0 |
| | 6 | 323.9 | 20.5 | 950 | 650 | 622 | 530 | Yes | F + B + M | 0 |
| | 7 | 323.9 | 35.2 | 950 | 650 | 618 | 545 | Yes | F + B + M | 0 |
| | 8 | 323.9 | 21.1 | 950 | 650 | 620 | 534 | Yes | F + B + M | 0 |
| | 9 | 219.1 | 16.7 | 950 | 650 | 584 | 525 | Yes | F + B + M | 0 |
| | 10 | 219.1 | 20.6 | 950 | 650 | 579 | 519 | Yes | F + B + M | 0 |
| | 11 | 219.1 | 19.1 | 950 | 650 | 588 | 537 | Yes | F + B + M | 0 |
| | 12 | 219.1 | 28.6 | 950 | 650 | 606 | 523 | Yes | F + B + M | 0 |
| | 13 | 219.1 | 39.7 | 950 | 650 | 584 | 525 | Yes | F + B + M | 0 |
| | 14 | 219.1 | 31.8 | 950 | 650 | 598 | 534 | Yes | F + B + M | 0 |
| Comparative example | 15 | 219.1 | 28.9 | 950 | 650 | 644 | 520 | *No | B + M | 12.6 |
| | 16 | 355.6 | 23.8 | 950 | 650 | 681 | 591 | *No | B + M | 7.9 |

TABLE 2-continued

| | Steel pipe size | | Heat treatment condition | | Test result | | | | |
|---|---|---|---|---|---|---|---|---|---|
| Steel No. | Outer diameter (mm) | Wall thickness (mm) | Cooling starting temperature (° C.) | Tempering temperature (° C.) | TS (MPa) | YS (MPa) | Ferrite precipitation at grain boundary | Microstructure | CAR (%) |
| 17 | 323.9 | 17.5 | 950 | 650 | 653 | 566 | Yes | F + B + M | 6.2 |
| 18 | 219.1 | 16.7 | 950 | 650 | 600 | 530 | Yes | F + B + M | 3.6 |
| 19 | 323.9 | 34.1 | 950 | 650 | 590 | 524 | *No | B + M | 10.8 |
| 20 | 219.1 | 37.8 | 950 | 650 | 523 | *474 | Yes | F + B | 0 |
| 21 | 323.9 | 20.5 | 950 | 650 | 585 | 519 | Yes | F + B + M | 9.4 |

Note:
Structure in Table shows B: Bainite, M: Martensite, F: Ferrite.
"*" in Table shows out of range specified in the present invention.

In the comparative examples, the steel of No. 19 has Mn content outside the specified values of the present invention and ferrite does not exist at the interface whereby a deteriorated result of CAR=10.8% was obtained. Further, the steel of No. 20 has C content outside the specified values of the present invention, so cannot satisfy strength of 5L-X70 grade, even if the result of CAR=0% was excellent.

Further, in the comparative examples, the steel of No. 21 has Ca content outside the specified values of the present invention and a deteriorated result of CAR=9.4% was obtained due to inclusions.

As in Example 1, tensile test specimens of JIS 12 were taken and as tensile tests, tensile strength (TS) and yield strength (YS) were measured. Further, HIC resistance tests were performed under the same conditions as in Example 1, and crack area ratios (CAR (%)) were measured. Further, after HIC resistance testing, cross-sections of HIC test specimens were cut off and microstructure observation was performed by an optical microscope. These results are shown in Table 3.

TABLE 3

| | | | Steel pipe size | | Heat treatment condition | | | | Test result | | | | |
|---|---|---|---|---|---|---|---|---|---|---|---|---|---|
| | Steel No. | Test No. | Outer diameter (mm) | Wall thickness (mm) | Temperature before soaking (° C.) | Cooling starting temperature (° C.) | Cooling rate (° C./sec) | Tempering temperature (° C.) | TS (MPa) | YS (MPa) | Ferrite precipitation at grain boundary | Microstructure | CAR (%) |
| Present invention example | 3 | 22 | 219.1 | 37.8 | 920 | 1080 | 30 | 650 | 614 | 553 | Yes | F + B + M | 0 |
| | 3 | 23 | 219.1 | 37.8 | 920 | 980 | 30 | 650 | 609 | 542 | Yes | F + B + M | 0 |
| | 3 | 24 | 219.1 | 37.8 | 920 | 900 | 30 | 650 | 590 | 513 | Yes | F + B + M | 0 |
| | 3 | 25 | 219.1 | 37.8 | 920 | 850 | 30 | 650 | 564 | 491 | Yes | F + B + M | 0 |
| | 3 | 26 | 219.1 | 37.8 | 920 | 950 | 30 | 650 | 568 | 494 | Yes | F + B + M | 0 |
| | 3 | 27 | 219.1 | 37.8 | 920 | 950 | 30 | 600 | 605 | 532 | Yes | F + B + M | 0 |
| | 3 | 28 | 219.1 | 37.8 | 920 | 950 | 30 | 570 | 610 | 537 | Yes | F + B + M | 0 |
| Comparative example | 3 | 29 | 219.1 | 37.8 | 920 | *1150 | 30 | 650 | 647 | 589 | *No | B + M | *7.4 |
| | 3 | 30 | 219.1 | 37.8 | 920 | 950 | 30 | *750 | 521 | *443 | Yes | F + B + M | 0 |
| | 3 | 31 | 219.1 | 37.8 | 920 | 950 | *4 | 650 | 478 | *287 | Yes | *F + P | 0 |
| | 3 | 32 | 219.1 | 37.8 | 920 | *750 | 30 | 650 | 509 | *438 | Yes | F + B + M | 0 |
| | 3 | 33 | 219.1 | 37.8 | 920 | 950 | 30 | *500 | 642 | 578 | Yes | F + B + M | 0 |

Note:
Structure in Table shows B: Bainite, M: Martensite, F: Ferrite, P: Pearlite.
"*" in Table shows out of range specified in the present invention.

EXAMPLE 2

To confirm effects of heat treatment conditions, the steel of No. 3 in Table 1 was melted by converter, and an billet produced by continuous casting was heated to 1100° C. or more and a hollow shell was obtained by use of a inclined rolling mill. The hollow shell was finish rolled to a steel pipe by a mandrel mill and a sizer. After that the steel pipe was cooled in a range of 920° C. to 20° C., and seamless steel pipes were produced by changing the cooling starting temperature, cooling rate and tempering temperature. The sizes of the produced steel pipes and heat treatment conditions are shown in Table 3. In this case, the $Ar_3$ point of the tested steel of No. 3 was 768° C., and the $Ac_1$ point thereof was 745° C.

As apparent from the results in Table 3, the steels of test Nos. 22 to 28 according to examples of the present invention satisfy heat treatment conditions specified in the present invention, and the all steels thereof satisfy strength of 5L-X70 grade, and have an excellent condition of CAR=0%.

On the other hand, the steel of test No. 29 in comparative examples adopts a quenching temperature, which is outside the specified values of the present invention, and ferrite is not precipitated at the grain boundaries whereby a deteriorated result of CAR=7.4% was obtained. Also the steel of test No. 30 adopts a tempering temperature, which is outside the specified values of the present invention, and the strength could not satisfy 5L-X70 grade.

Further, in the comparative examples, the steel of test No. 31 adopts a cooling rate outside the specified values of the present invention and the microstructure of the steel is a ferrite-pearlite microstructure whereby the strength of the steel could not satisfy 5L-X70 grade.

Further, since in the steel of test No. 32 the starting temperature of quenching was less than ($Ar_3$ point+50° C.), the strength of the steel could not satisfy 5L-X70 grade.

Furthermore, in the comparative examples the steel of test No. 33 could not ensure a tempering temperature of 550° C. or more, an additional welding test was performed and it was found that the strength was decreased in a welding heat affected zone.

INDUSTRIAL APPLICABILITY

In the seamless steel pipe and its production method according to the present invention, the chemical compositions of the steels, the microstructure of the steel, and the precipitation of ferrite at grain boundaries in the steels are specified. Accordingly, the steel can obtain high strength and stable, excellent HIC resistance. Further, by specifying the conditions in a case where an inline QT is applied a pipeline having excellent HIC resistance and high yield stress of 483 MPa or more can be provided without inhibiting the cost down or cost saving of heat treatment process and the improvement of productivity. Therefore, the seamless steel pipe and its production method of the present invention can be utilized widely in technical fields requiring for a high strength seamless steel pipe excellent in HIC resistance.

What is claimed is:

1. A high strength seamless steel pipe excellent in hydrogen-induced cracking resistance, characterized by consisting essentially of, by mass %, C: 0.03-0.11%, Si: 0.05-0.5%, Mn: 0.8-1.6%, P: 0.025% or less, S: 0.003% or less, Ti: 0.002-0.017%, Al: 0.001-0.10%, Cr: 0.05-0.5%, Mo: 0.02-0.3V: 0.02-0.20%, Ca: 0.0005-0.005%, N: 0.008% or less and O (Oxygen): 0.004% or less, and the balance Fe and impurities, and also characterized in that the microstructure of the steel is bainite and martensite, ferrite is precipitated at grain boundaries and yield stress is 483 MPa or more.

2. A high strength seamless steel pipe excellent in hydrogen-induced cracking resistance according to claim 1, characterized by further containing, by mass %, at least one of Cu: 0.05-0.5% and Ni: 0.05-0.5%.

* * * * *